US005931340A

United States Patent [19]

Savage et al.

[11] Patent Number: 5,931,340

[45] Date of Patent: Aug. 3, 1999

[54] DISPENSER INCORPORATING STORAGE AND RETRIEVER MODULE

[75] Inventors: Kent Vickers Savage, Morrow; Richard Mathias Alden, Cincinnati; Kenneth John Pfeiffer, Fairfield, all of Ohio

[73] Assignee: Vertex Technologies, Inc., Cincinnati, Ohio

[21] Appl. No.: 08/915,825

[22] Filed: Aug. 21, 1997

[51] Int. Cl.[6] ..... G07F 11/00

[52] U.S. Cl. ..... 221/88; 221/131; 221/237; 221/DIG. 1

[58] Field of Search ..... 221/7, 13, 87, 221/88, 89, 69, 130, 131, 196, 188, 237, DIG. 1

[56] References Cited

U.S. PATENT DOCUMENTS

| | | | |
|---|---|---|---|
| 2,071,771 | 2/1937 | Shield | 221/131 |
| 2,957,604 | 10/1960 | Goldman et al. | 221/88 |
| 2,998,901 | 9/1961 | Arnold | 221/88 |
| 3,348,732 | 10/1967 | Schwarz | 221/123 |
| 4,681,504 | 7/1987 | Welch, Sr. | 414/268 |
| 4,953,745 | 9/1990 | Rowlett | 221/7 |
| 5,025,950 | 6/1991 | Trouteaud et al. | 221/5 |
| 5,133,478 | 7/1992 | Gordon | 221/69 |
| 5,205,436 | 4/1993 | Savage | 221/7 |
| 5,791,512 | 8/1998 | Kanatsuka | 221/131 |

FOREIGN PATENT DOCUMENTS

| | | | |
|---|---|---|---|
| 0 391 059 | 10/1990 | European Pat. Off. . | |
| 85 14 600 | 10/1985 | Germany . | |
| 0188897 | 7/1990 | Japan | 221/196 |
| 43 10 103 | 8/1993 | United Kingdom . | |

*Primary Examiner*—H. Grant Skaggs

[57] ABSTRACT

A dispenser is provided comprising a housing, a plurality of storage trays, a retriever module, a user interface, and a controller in communication with the user interface. The controller is operative to cause the retriever module to move towards a selected storage tray in response to a selection signal. Further, a dispensing module is provided comprising a housing arranged to permit insertion of the housing into an existing storage system.

20 Claims, 8 Drawing Sheets

DISPENSER INCORPORATING STORAGE AND RETRIEVER MODULE

BACKGROUND OF THE INVENTION

The present invention relates to product dispensing and, more particularly, to an improved dispenser for dispensing controlled items, such as, tools, office and industrial supplies, replacement parts, drugs, food items, perishable goods, safety supplies, welding supplies, protective devices, electronic components, work supplies, food, apparel, personal care items, compact discs, etc.

Product dispensing machines are now being used in increasing numbers for a relatively wide range of purposes. It is often necessary for a single dispenser to selectively dispense one or more of a variety of distinct items. Many conventional dispensers are not well suited for selective dispensing of this nature because their design dictates that a significant amount of space be reserved within the dispenser for each different item type to be dispensed. Although some conventional dispensers are capable of vending articles of many different types with a single article conveyor mechanism, these dispensers typically incorporate a complex and costly design that occupies a significant amount of space for each item to be dispensed. Further, these conventional dispensers are not well suited for differing product sizes and shapes, and their design does not permit inclusion of product compartments of differing sizes.

If one wishes to move from a conventional storage system to a selective dispensing system, conventional dispensers do not provide a means by which conventional storage cabinets may be modified to operate as item-selective dispensers. The conventional storage system must be replaced with conventional dispensers and, as a result, the entire storage scheme must be reconfigured. Further, in many instances, the storage system structure itself must be discarded to make room for the new dispensing unit.

Accordingly, there is a need for a product dispenser that is capable of selectively dispensing one or more of a variety of distinct items, occupies a minimum amount of dispenser space per dispensable item, incorporates a simple and cost effective design, is well suited for differing product sizes and shapes, and permits inclusion of product compartments of differing sizes. There is a further need for a product dispensing module which is designed to be incorporated in existing storage systems.

BRIEF SUMMARY OF THE INVENTION

This need is met by the present invention wherein a dispenser is provided comprising a housing, a plurality of storage trays, a retriever module, a user interface, and a controller in communication with the user interface. The controller is operative to cause the retriever module to move towards a selected storage tray in response to a selection signal. Further, a dispensing module is provided comprising a housing arranged to permit insertion of the housing into an existing storage system.

In accordance with one embodiment of the present invention, a dispenser is provided comprising a housing, a plurality of storage trays, a retriever module, a user interface, and a controller. The housing defines a front end, a rear end, and a primary longitudinal axis extending between the front end and the rear end. The plurality of storage trays are secured to the housing and define secure conditions and item release conditions. The retriever module is secured to the housing and is operative to move in a retrieve direction substantially parallel to the primary longitudinal axis. The retriever module includes at least one engagement member positioned to couple movement of the retriever module in the retrieve direction with movement of a selected storage tray from the secure condition to the release condition. The user interface is operative to produce a selection signal indicative of an item selection. The controller is in communication with the user interface and is operative to cause the retriever module to move towards a selected storage tray in the retrieve direction in response to the selection signal.

The dispenser may further comprise a receiver bin positioned to receive an item released from the selected storage tray in the item release condition. The housing preferably includes a front end, a rear end, a top side, a bottom side, a pair of lateral sides defining a first substantially rectangular cross section perpendicular to the primary longitudinal axis and arranged to permit insertion of the housing into a cavity having a second substantially rectangular cross section.

The plurality of storage trays may include catches and the retriever module may be operative to cause the at least one engagement member to engage a selected catch. The engagement members are mounted so as to be movable between a catch engaging position and a non-engaging position independent of movement of the retriever module in the retrieve direction.

The plurality of storage trays may be arranged in an array comprising a first plurality of storage trays distributed along the primary longitudinal axis, a second plurality of storage trays distributed along a secondary longitudinal axis laterally offset from the primary longitudinal axis, and a third plurality of storage trays distributed along a tertiary longitudinal axis laterally offset from the primary and secondary longitudinal axes. Similarly, the retriever module may include a first engagement member positioned to couple movement of the retriever module in the retrieve direction with movement of a selected storage tray of the first plurality of storage trays from the secure condition to the release condition, a second engagement member positioned to couple movement of the retriever module in the retrieve direction with movement of a selected storage tray of the second plurality of storage trays from the secure condition to the release condition, and a third engagement member positioned to couple movement of the retriever module in the retrieve direction with movement of a selected storage tray of the third plurality of storage trays from the secure condition to the release condition. The controller may be operative to position selectively one or more of the first, second, and third engagement members to couple movement of the retriever module in the retrieve direction with movement of a corresponding storage tray of at least one of the first, second, and third pluralities of storage trays.

The retriever module is preferably mounted for movement along a single linear axis. The housing may include a top side plate including storage tray closures formed on a surface of the top side plate. The housing may also include a dispense stop positioned to cause the receiver bin to dispense an item held therein upon movement of the receiver bin to the front end of the housing.

In accordance with another embodiment of the present invention, a dispensing module is provided comprising a housing, a plurality of storage trays, and a retriever module. The housing includes a front end, a rear end, a top side, a bottom side, a pair of lateral sides, and a primary longitudinal axis extending from the front end to the rear end. The housing defines a first substantially rectangular cross section perpendicular to the primary longitudinal axis and is arranged to permit insertion of the housing into a cavity having a second substantially rectangular cross section. The plurality of storage trays are secured to the housing and each of the storage trays define a secure condition and an item release condition. The retriever module is secured to the housing and is operative to move in a retrieve direction substantially parallel to the primary longitudinal axis in response to a selection signal. The retriever module includes at least one engagement member positioned to couple movement of the retriever module in the retrieve direction with movement of a selected storage tray from the secure condition to the release condition.

In accordance with yet another embodiment of the present invention, a dispenser is provided comprising a storage cabinet and at least one dispensing module. The storage cabinet comprises a cabinet frame defining a plurality of storage compartments. The dispensing module is positioned within a selected one of the plurality of storage compartments. The dispensing module comprises a housing, a plurality of storage trays, and a retriever module. The housing including a front end, a rear end, a top side, a bottom side, a pair of lateral sides, and a primary longitudinal axis extending from the front end to the rear end. The housing defines a first substantially rectangular cross section perpendicular to the primary longitudinal axis and is arranged to permit insertion of the housing into a cavity having a second substantially rectangular cross section. The storage trays are secured to the housing and each of the storage trays define a secure condition and an item release condition. A retriever module is secured to the housing and is operative to move in a retrieve direction substantially parallel to the primary longitudinal axis in response to a selection signal. The retriever module includes at least one engagement member positioned to couple movement of the retriever module in the retrieve direction with movement of a selected storage tray from the secure condition to the release condition.

Accordingly, it is an object of the present invention to provide a product dispenser that is capable of selectively dispensing one or more of a variety of distinct items, occupies a minimum amount of dispenser space per dispensable item, incorporates a simple and cost effective design, is well suited for differing product sizes and shapes, and permits inclusion of product compartments of differing sizes. It is a further object of the present invention to provide a product dispensing module which is designed to be incorporated in existing storage systems.

DETAILED DESCRIPTION OF THE PREFERRED EMBODIMENTS

Figure 1:
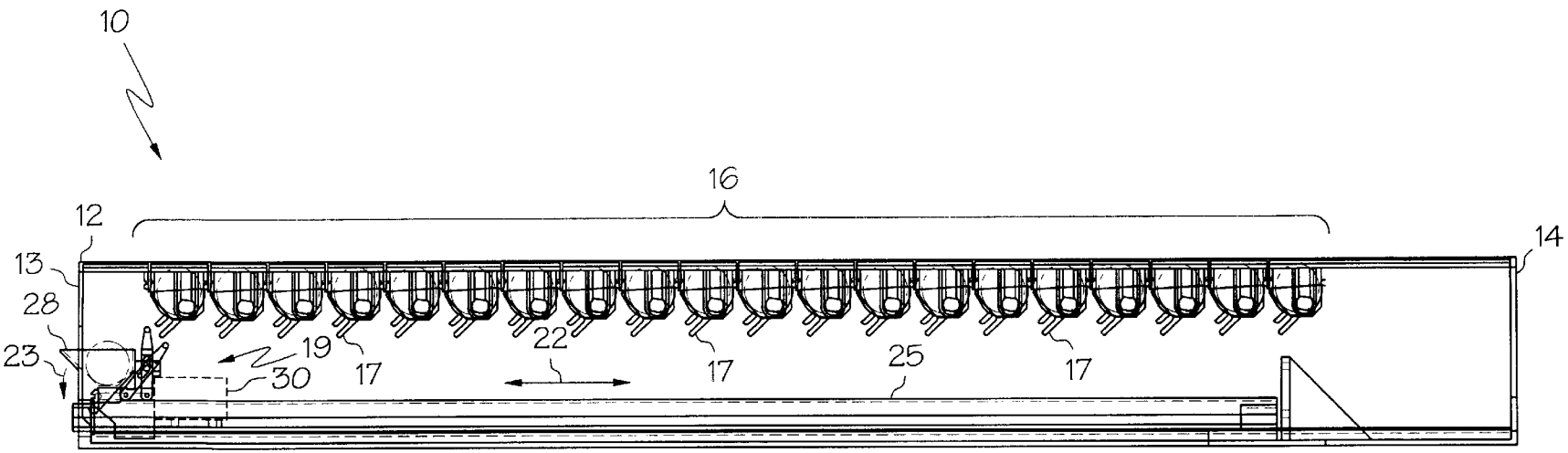
FIG. 1 is a schematic side view of a dispenser according to the present invention.
Figure 2:
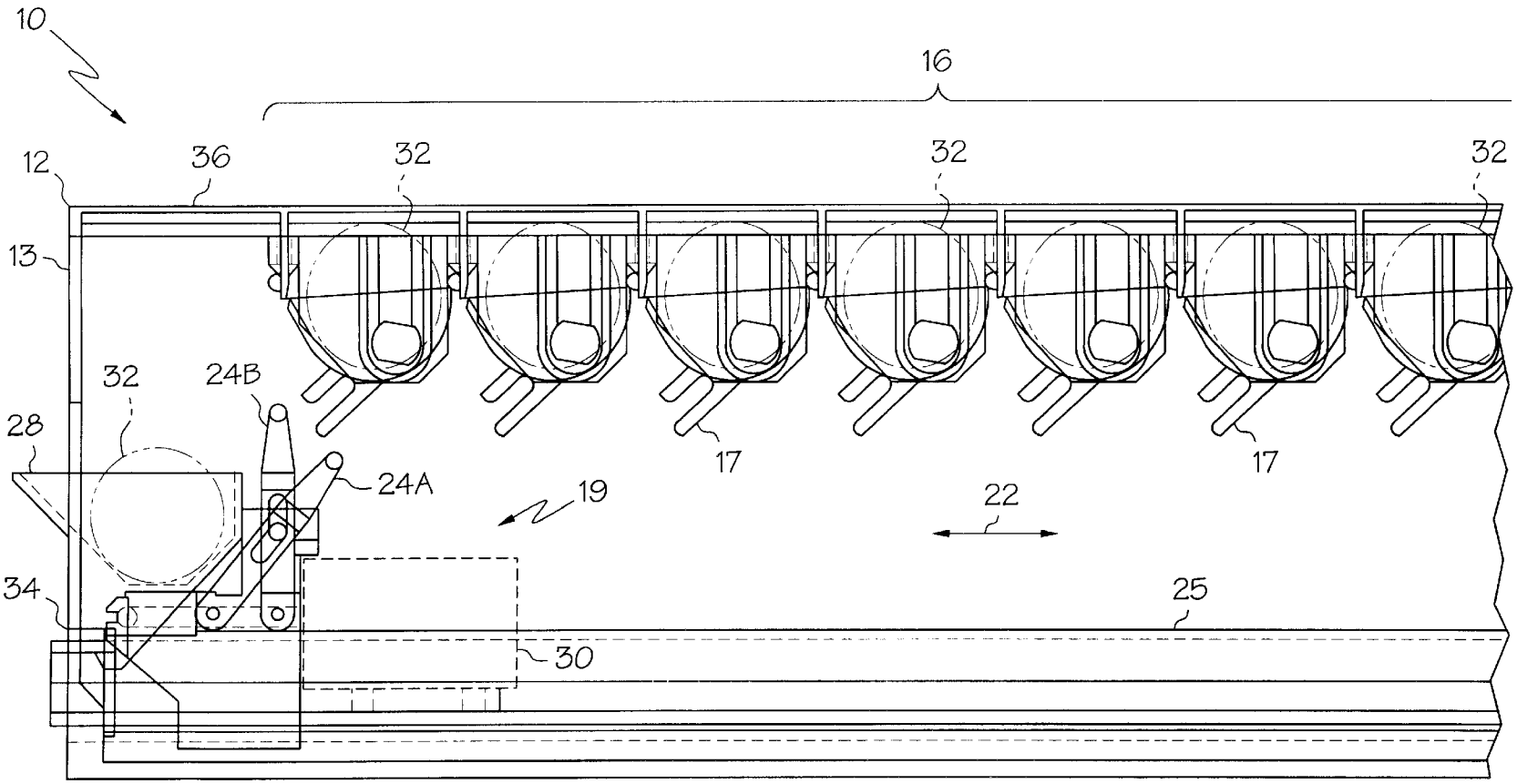
FIG. 2 is a blown up view, partially broken away, of a portion of the dispenser illustrated in FIG. 1.

Referring primarily to FIGS. 1 and 2, and with further reference to FIGS. 3–7, a dispenser according to the present invention comprises a dispensing module 10, a housing 12, a plurality of storage trays 16, a retriever module 19, and a controller 30. The housing 12 defines a front end 13, a rear end 14, and a primary longitudinal axis 15*a* extending between the front end 13 and the rear end 14, see FIG. 3.

The storage trays 16 are secured to the housing 12. Each of the storage trays 16 defines a secure condition and an item release condition, e.g., an upright condition and a tipped condition. The trays illustrated in FIGS. 1 and 2 are positioned in the secure condition. The trays 16 may be pivoted or tipped about a pivot 18 to an item release position, as indicated by directional arrow 21, see FIG. 5. The pivot 18 defines a pivot axis substantially perpendicular to the primary longitudinal axis 15*a*.

Figure 3:
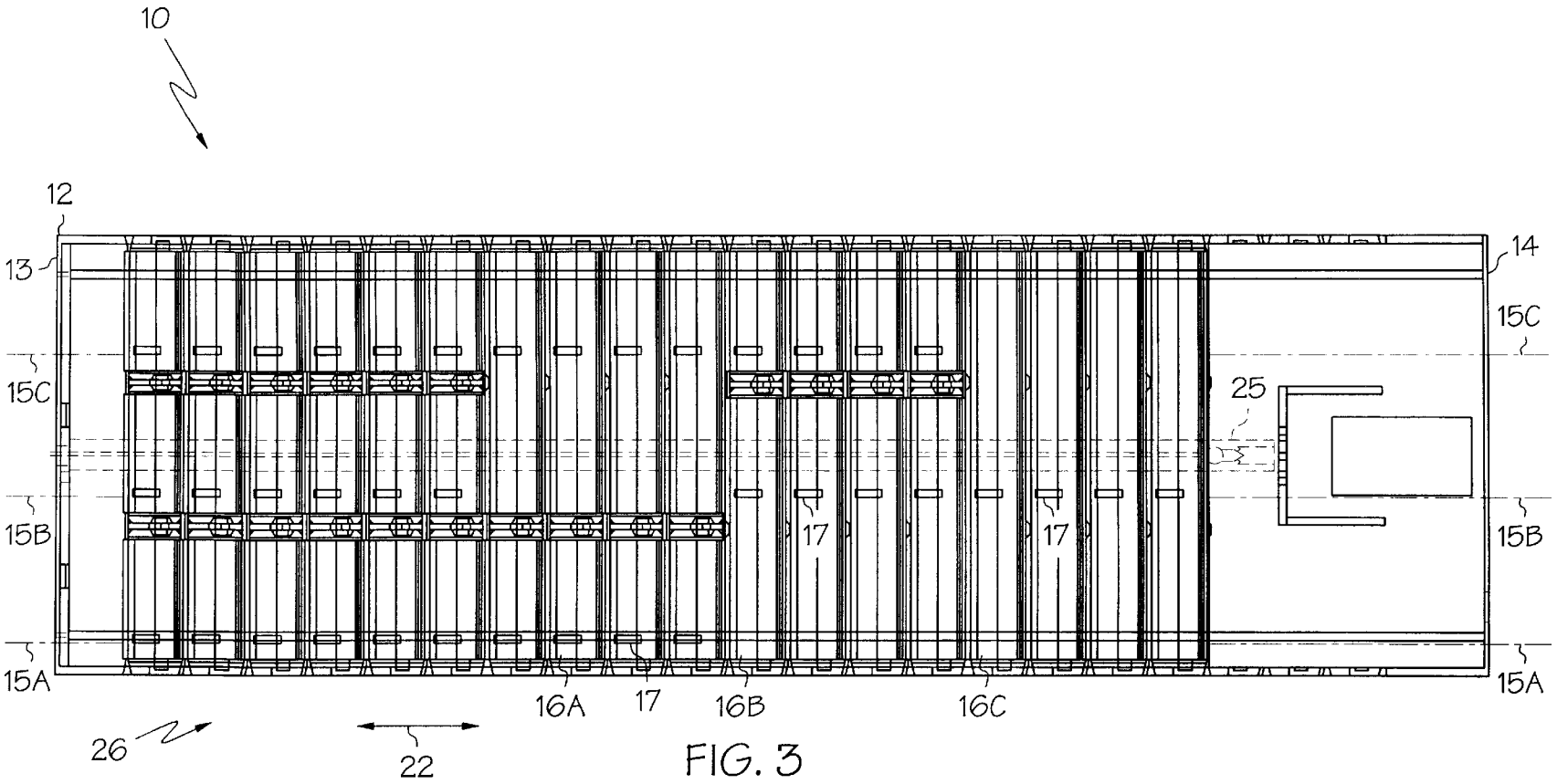
FIG. 3 is a schematic top view of the dispenser illustrated in FIG. 1.

The storage trays 16 are arranged in an array 26, as is illustrated in FIG. 3. The array 26 comprises a first plurality of storage trays 16 distributed along the primary longitudinal axis 15*a*, a second plurality of storage trays 16 distributed along a secondary longitudinal axis 15*b* laterally offset from the primary longitudinal axis 15*a*, and a third plurality of storage trays 16 distributed along a tertiary longitudinal axis 15*c* laterally offset from the primary and secondary longitudinal axes 15*a*, 15*b*. A specific tray 16 may be a single wide tray 16*a* arranged along one of the axes 15*a*, 15*b*, 15*c*, a double wide tray 16*b* arranged along two of the axes 15*a*, 15*b*, 15*c*, or a triple wide tray 16*c* arranged along three of the axes 15*a*, 15*b*, 15*c*, see FIGS. 3 and 4. Each tray 16 is provided with a catch 17. Each catch 17 is positioned on one of the three longitudinal axes 15*a*, 15*b*, 15*c*.

The retriever module 19 is secured to the housing 12 and is operative to move in a retrieve direction 22 substantially parallel to the axes 15*a*, 15*b*, 15*c* along a rail 25 of a motorized mechanical guidance system. It is contemplated by the present invention that any one of a variety of motive mechanisms may be utilized in the present invention to impart movement to the retriever module 19 along the retrieve direction 22.

Figure 4:
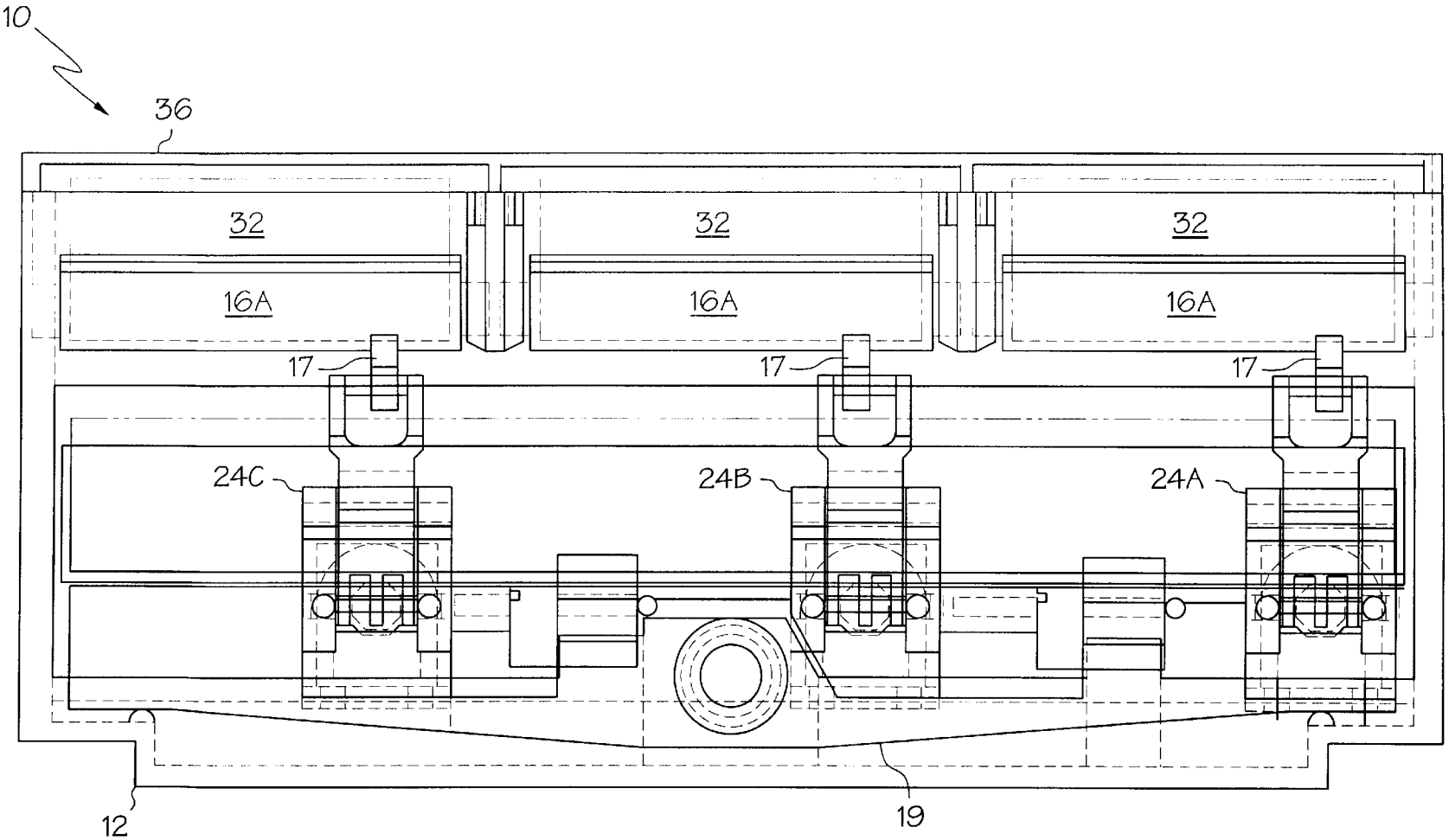
FIG. 4 is a schematic front view of the dispenser illustrated in FIG. 1.
Figure 5:
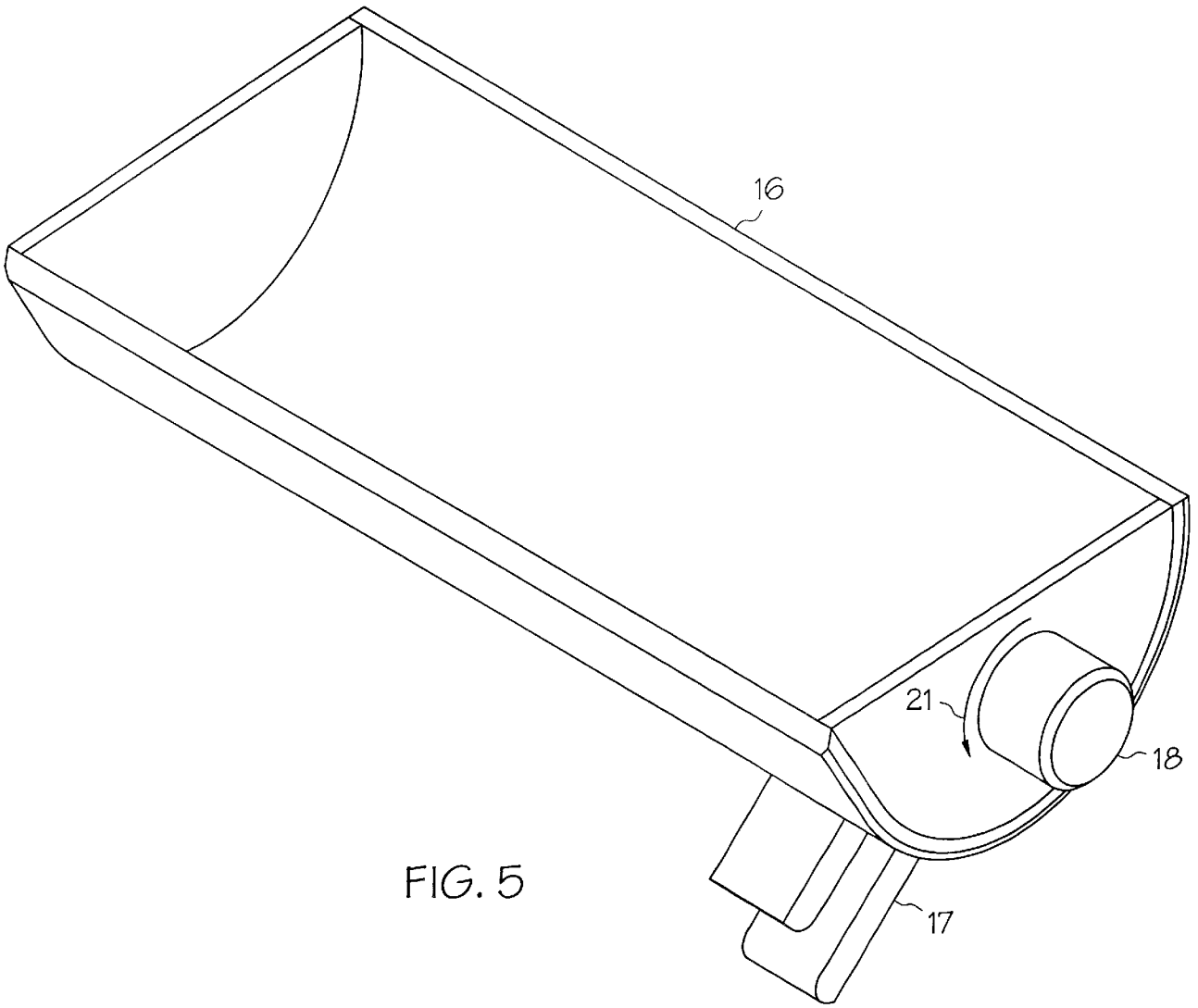
FIG. 5 is an isometric view of a storage tray of the dispenser of FIG. 1.

The retriever module 19 includes a first engagement member 24*a* positioned along the primary longitudinal axis 15*a*, a second engagement member 24*b* positioned along the secondary longitudinal axis 15*b*, and a third engagement member 24*c* positioned along the tertiary longitudinal axis 15*c*, see FIGS. 2–4. In this manner, each catch 17 may be positioned in the path of one of the engagement members 24*a*, 24*b*, 24*c*. Further, each engagement member 24*a*, 24*c*, 24*c* is positioned to couple movement of the retriever module 19 in the retrieve direction 22 with movement of a selected storage tray 16 to its item release condition. This coupling is accomplished by moving the retriever module 19 towards a selected tray 16 and causing the appropriate engagement member 24*a*, 24*b*, 24*c* to move from a non-engaging position to a catch engaging position when the engagement member 24*a*, 24*b*, 24*c* is proximate the catch 17 of the selected tray 16. The coupling causes the tray 16 to tip in the direction indicated by arrow 21 as the retriever module 19 moves in the retrieve direction 22, see FIGS. 1 and 5. The catch engaging position and the non-engaging position are illustrated in FIG. 2, where engagement member 24*a* lies in a non-engaging position and engagement member 24*b* lies in a catch engaging position. The engagement members are mounted so as to be movable from the non-engaging to the catch engaging position independent of the movement of the retriever module 19 along the axes 15*a*, 15*b*, 15*c* in the retrieve direction 22. It is contemplated that movement from the non-engaging position to the engaging position could provide the motion necessary to move the selected tray 16 from the secure position to the item release position.

As will be appreciated by those skilled in the art, each storage tray 16 is biased towards the secure condition, e.g., by spring force, by counterbalancing the tray 16 relative to the pivot 18, etc. As will be further appreciated by those practicing the present invention, appropriate motion control means are provided in communication with the retriever module 19 to ensure that the retriever module 19 moves back and forth in the retrieve direction 22 so as to engage and move a selected storage tray 16 from the secure condition to the item release condition. Finally, it is contemplated that movement in the retrieve direction 22 may be initiated from a designated home position and may be characterized by unidirectional movement towards one of the front end 13 and the rear end 14 or bi-directional movement towards the front end 13 and the rear end 14.

Figure 6:
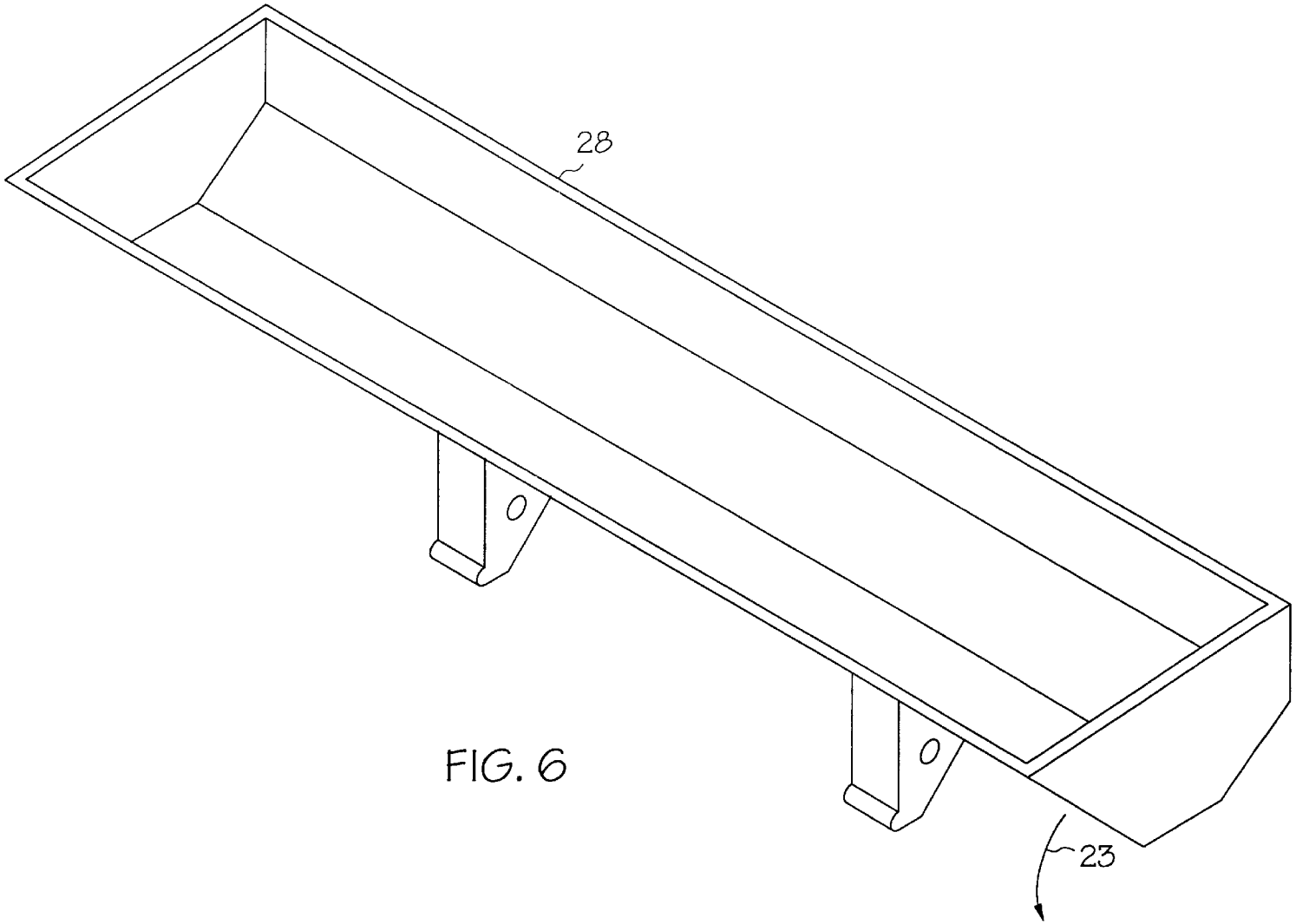
FIG. 6 is an isometric view of a receiver bin of the dispenser of FIG. 1.

A receiver bin 28, see FIGS. 1, 2, and 6, is positioned to receive an item 32 released from the selected storage tray 16 when the storage tray 16 moves to the item release condition. For example, where the storage tray 16 moves to the item release condition by tipping in the direction 21, see FIG. 5, the item 32 held in the storage tray falls out of the tray 16 and is directed to the receiver bin 28. The housing 12 includes a dispense stop 34 positioned to cause the receiver bin 28 to dispense an item 32 held therein upon movement of the receiver bin 28 to the front end of the housing 12. Specifically, the dispense stop 34 is positioned at the front end 13 of the housing 12 and causes the receiver bin to tip to a dispense position, as indicated by directional arrow 23, see FIG. 6. As will be appreciated by those skilled in the art, the receiver bin 28 is biased away from the dispense position, e.g., by spring force or otherwise.

Figure 7:
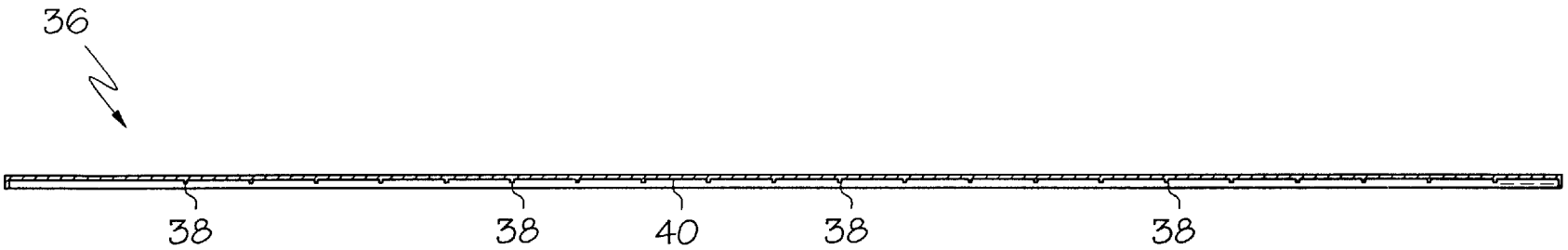
FIG. 7 is a schematic side view of a top side plate of the dispenser of FIG. 1.

The housing 12 includes a top side plate 36 including storage tray closures 38 formed on a lower surface 40 of the top side plate 36, see FIG. 7. The closures 38 function to secure items 32 within each storage tray 16. The particular shape of the closures 38 and the contour of the lower surface 40 may be customized to correspond as closely as possible to the shape of the item 32 held within the tray 16.

Figure 8:
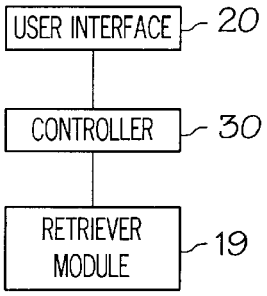
FIG. 8 is a schematic view of the major electronic components of the dispenser according to the present invention.

Referring now to FIG. 8, a user interface 20 is provided in communication with the controller 30 and is operative to produce a selection signal indicative of an item selection made by a dispenser operator. The controller 30 is operative to cause the retriever module 19 to move towards a selected storage tray 16 in the retrieve direction 22 in response to the selection signal. Further, the controller 30 causes the appropriate engagement member 24*a*, 24*b*, 24*c* to move between the non-engaging and catch engaging positions to enable release of the item 32 and return of the tray 16 to the secure condition. Finally, the retriever module is caused to move towards the front end 13 and dispense an item held in the receiver bin 28. It is contemplated by the present invention that the controller may be operative to position selectively one of the first engagement member, the second engagement member, the third engagement member, and combinations thereof, to couple movement of the retriever module with movement of one or more corresponding storage trays. In this manner, a single item or a plurality of items may be dispensed according to the present invention.

Figure 9:
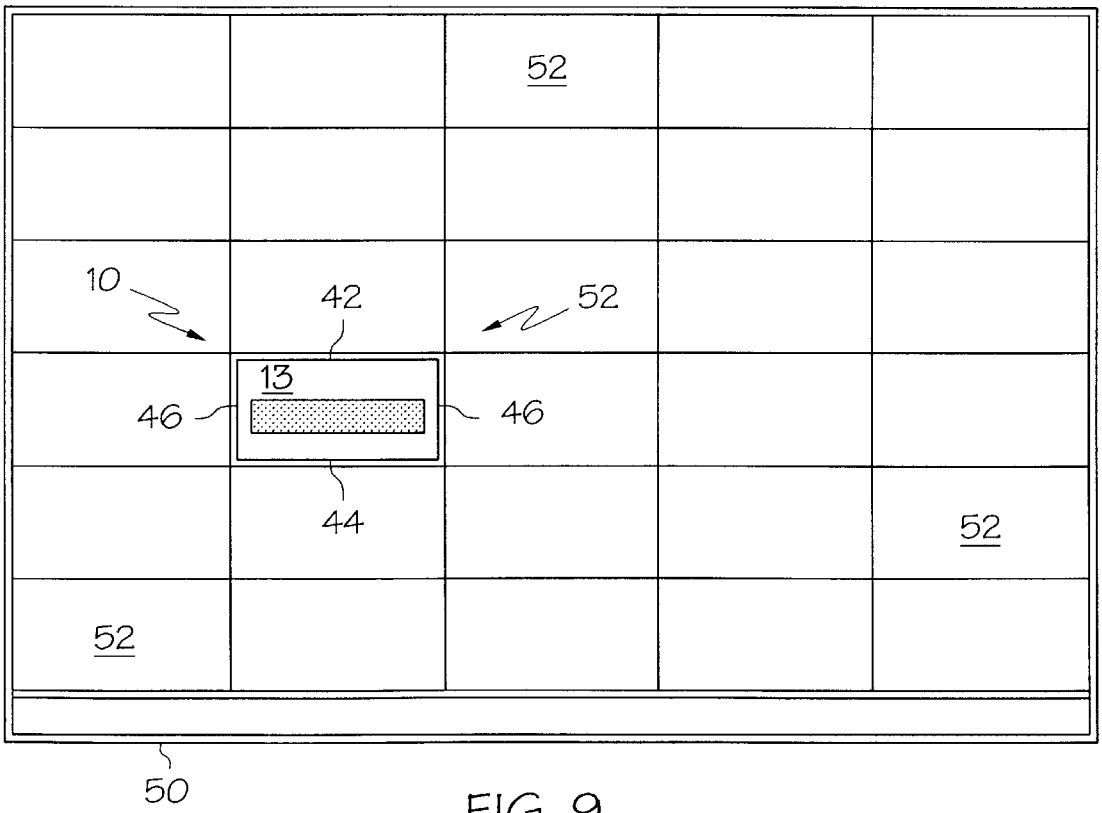
FIG. 9, is a schematic illustration of a dispenser incorporating a storage cabinet and a dispensing module according to the present invention.

A dispenser incorporating a storage cabinet 50 and a dispensing module 10 is illustrated with reference to FIGS. 1, 3, and 9. The housing 12 of the dispensing module 10 includes the front end 13, the rear end 14, a top side 42, a bottom side 44, and a pair of lateral sides 46. The housing 12 defines a first substantially rectangular cross section perpendicular to the primary longitudinal axis 15*a* and is arranged to permit insertion into a cavity or cabinet compartment 52 having a second substantially rectangular cross section. Specifically, the front end 13, rear end 14, top side 42, bottom side 44, and pair of lateral sides 46 are constructed so as to be free of any structural projections or other obstructions to insertion into the cavity 52. Further, the housing 12 as a whole forms a structurally sound stand-alone unit with a substantially uniform rectangular cross section that can be readily moved from one position to the next without difficulty. As will be appreciated by those practicing the present invention, a plurality of dispensing modules 10 may be provided in respective cavities of compartments 52 of the cabinet 50.

Having described the invention in detail and by reference to preferred embodiments thereof, it will be apparent that modifications and variations are possible without departing from the scope of the invention defined in the appended claims.

What is claimed is:

1. A dispenser comprising:

a housing defining a front end, a rear end, and a primary longitudinal axis extending between said front end and said rear end;

a plurality of storage trays secured to said housing, each of said storage trays defining a secure condition and an item release condition;

a retriever module secured to said housing and operative to move in a retrieve direction substantially parallel to said primary longitudinal axis, wherein said retriever module includes at least one engagement member positioned to couple movement of said retriever module in said retrieve direction with movement of a selected storage tray from said secure condition to said release condition;

a user interface operative to produce a selection signal indicative of an item selection; and a controller in communication with said user interface, said controller being operative to cause said retriever module to move towards a selected storage tray in said retrieve direction in response to said selection signal.

2. A dispenser as claimed in claim 1 further comprising a receiver bin positioned to receive an item released from said selected storage tray in said item release condition.

3. A dispenser as claimed in claim 1 wherein said housing includes a front end, a rear end, a top side, a bottom side, a pair of lateral sides, wherein said housing defines a first substantially rectangular cross section perpendicular to said primary longitudinal axis, and wherein said housing is arranged to permit insertion of said housing into a cavity having a second substantially rectangular cross section.

4. A dispenser as claimed in claim 1 wherein each of said plurality of storage trays includes a catch and wherein said retriever module is operative to cause said at least one engagement member to engage a selected catch.

5. A dispenser as claimed in claim 4 wherein said at least one engagement member is mounted so as to be movable between a catch engaging position and a non-engaging position independent of movement of said retriever module in said retrieve direction.

6. A dispenser as claimed in claim 1 wherein said plurality of storage trays are arranged in an array, said array comprising a first plurality of storage trays distributed along said primary longitudinal axis and a second plurality of storage trays distributed along a secondary longitudinal axis laterally offset from said primary longitudinal axis.

7. A dispenser as claimed in claim 6 wherein at least one of said first plurality of storage trays is distributed along said primary longitudinal axis and said secondary longitudinal axis.

8. A dispenser as claimed in claim 6 wherein said retriever module includes:

a first engagement member positioned to couple movement of said retriever module in said retrieve direction with movement of a selected storage tray of said first plurality of storage trays from said secure condition to said release condition; and a second engagement member positioned to couple movement of said retriever module in said retrieve direction with movement of a selected storage tray of said second plurality of storage trays from said secure condition to said release condition.

9. A dispenser as claimed in claim 8 wherein said controller is operative to position selectively one of said first engagement member, said second engagement member, and said first and second engagement members to couple movement of said retriever module in said retrieve direction with movement of a corresponding storage tray of at least one of said first and second pluralities of storage trays.

10. A dispenser as claimed in claim 1 wherein said plurality of storage trays are arranged in an array, said array comprising a first plurality of storage trays distributed along said primary longitudinal axis, a second plurality of storage trays distributed along a secondary longitudinal axis laterally offset from said primary longitudinal axis, and a third plurality of storage trays distributed along a tertiary longitudinal axis laterally offset from said primary and secondary longitudinal axes.

11. A dispenser as claimed in claim 10 wherein said retriever module includes:

a first engagement member positioned to couple movement of said retriever module in said retrieve direction with movement of a selected storage tray of said first plurality of storage trays from said secure condition to said release condition;

a second engagement member positioned to couple movement of said retriever module in said retrieve direction with movement of a selected storage tray of said second plurality of storage trays from said secure condition to said release condition; and a third engagement member positioned to couple movement of said retriever module in said retrieve direction with movement of a selected storage tray of said third plurality of storage trays from said secure condition to said release condition.

12. A dispenser as claimed in claim 11 wherein said controller is operative to position selectively one of said first engagement member, said second engagement member, said third engagement member, said first and second engagement members, said first and third engagement members, said second and third engagement members, and said first, second, and third engagement members to couple movement of said retriever module in said retrieve direction with movement of a corresponding storage tray of at least one of said first, second, and third pluralities of storage trays.

13. A dispenser as claimed in claim 1 wherein said retriever module is mounted for movement along a single linear axis.

14. A dispenser as claimed in claim 1 wherein said housing includes a top side plate including storage tray closures formed on a surface of said top side plate.

15. A dispenser as claimed in claim 1 wherein said housing includes a dispense stop positioned to cause said receiver bin to dispense an item held therein upon movement of said receiver bin to said front end of said housing.

16. A dispenser as claimed in claim 1 wherein movement in said retrieve direction is characterized by uni-directional movement towards one of said front end and said rear end.

17. A dispenser as claimed in claim 1 wherein movement in said retrieve direction is characterized by bi-directional movement towards said front end and said rear end.

18. A dispenser as claimed in claim 1 wherein:

said plurality of storage trays are arranged in an array, said array comprising a first plurality of storage trays distributed along said primary longitudinal axis and a second plurality of storage trays distributed along a secondary longitudinal axis laterally offset from said primary longitudinal axis;

each of said plurality of storage trays is secured to said housing so as to be rotatable about a pivot axis substantially perpendicular to said primary longitudinal axis;

said item release condition is characterized by rotation about said pivot axis from said secure condition to said item release condition;

each of said plurality of storage trays includes a catch;

said retriever module is operative to cause said at least one engagement member to engage a selected catch;

said at least one engagement member is mounted so as to be movable from a catch engaging position to a non-engaging position, independent of movement of said retriever module in said retrieve direction;

said retriever module includes a first engagement member positioned to couple movement of said retriever module in said retrieve direction with movement of a selected storage tray of said first plurality of storage trays from said secure condition to said release condition, and a second engagement member positioned to couple movement of said retriever module in said retrieve direction with movement of a selected storage tray of said second plurality of storage trays from said secure condition to said release condition; and wherein said retriever module is mounted for movement along a single linear axis.

19. A dispensing module comprising:

a housing including a front end, a rear end, a top side, a bottom side, a pair of lateral sides, and a primary longitudinal axis extending from said front end to said rear end, wherein said housing defines a first substantially rectangular cross section perpendicular to said primary longitudinal axis, and wherein said housing is arranged to permit insertion of said housing into a cavity having a second substantially rectangular cross section;

a plurality of storage trays secured to said housing, each of said storage trays defining a secure condition and an item release condition; and a retriever module secured to said housing, said retriever module being operative to move in a retrieve direction substantially parallel to said primary longitudinal axis in response to a selection signal, wherein said retriever module includes at least one engagement member positioned to couple movement of said retriever module in said retrieve direction with movement of a selected storage tray from said secure condition to said release condition.

20. A dispenser comprising:

a storage cabinet comprising a cabinet frame, said cabinet frame defining a plurality of storage compartments; and at least one dispensing module positioned within a selected one of said plurality of storage compartments; wherein said at least one dispensing module comprises a housing including a front end, a rear end, a top side, a bottom side, a pair of lateral sides, and a primary longitudinal axis extending from said front end to said rear end, wherein said housing defines a first substantially rectangular cross section perpendicular to said primary longitudinal axis, and wherein said housing is arranged to permit insertion of said housing into a cavity having a second substantially rectangular cross section;

a plurality of storage trays secured to said housing, each of said storage trays defining a secure condition and an item release condition; and a retriever module secured to said housing, said retriever module being operative to move in a retrieve direction substantially parallel to said primary longitudinal axis in response to a selection signal, wherein said retriever module includes at least one engagement member positioned to couple movement of said retriever module in said retrieve direction with movement of a selected storage tray from said secure condition to said release condition.

* * * * *